United States Patent [19]

Matsui et al.

[11] Patent Number: 4,694,887

[45] Date of Patent: Sep. 22, 1987

[54] DUAL ROLL TYPE CONTINUOUS CASTING MACHINE

[75] Inventors: Kunio Matsui, Yokohama; Hisahiko Fukase, Tokyo; Akihiro Nomura, Yokohama, all of Japan

[73] Assignee: Ishikawajima-Harima Jukogyo Kabushiki Kaisha, Japan

[21] Appl. No.: 868,068

[22] Filed: May 29, 1986

[30] Foreign Application Priority Data

Aug. 23, 1985 [JP] Japan ..... 60-185085

[51] Int. Cl.[4] ..... B22D 11/06

[52] U.S. Cl. ..... 164/428; 164/437; 164/480; 164/135

[58] Field of Search ..... 164/428, 437, 480, 488, 164/463, 423, 135, 337

[56] References Cited

FOREIGN PATENT DOCUMENTS

| | | | |
|---|---|---|---|
| 77962 | 6/1980 | Japan | 164/428 |
| 188545 | 11/1983 | Japan | 164/428 |
| 21156 | 2/1985 | Japan | 164/428 |
| 21171 | 2/1985 | Japan | 164/428 |

*Primary Examiner*—Nicholas P. Godici
*Assistant Examiner*—Samuel M. Heinrich

[57] ABSTRACT

In a dual roll type continuous casting machine, molten-metal-pouring passages for feeding molten metal into a molten bath or pool are so disposed and oriented that molten metal is fed toward the side seal plates in the directions tangential to a pair of cooling rolls, whereby only solidified shells formed on the side seal plates at the so-called triple points are effectively melted.

6 Claims, 5 Drawing Figures

DUAL ROLL TYPE CONTINUOUS CASTING MACHINE

BACKGROUND OF THE INVENTION

The present invention relates to a dual roll type continuous casting machine capable of effectively preventing the so-called triple-point problem.

As shown in FIG. 1, a dual roll type continuous casting machine has a pair of cooling rolls 1 in parallel with each other and spaced apart from each other by a suitable distance as shown in FIG. 1. Side seal plates 2 are disposed at the ends of the cooling rolls 1 to define a molten bath or pool (in some cases, barrel seal plates are disposed, extending in the axial direction of the cooling rolls 1). Molten metal is poured into the molten bath and is cooled by the cooling rolls 1 which are rotated in the directions indicated by the arrows so that a cast piece 3 continuously emerges out of a roll gap between the rolls 1.

Solidified shells are developed over the surfaces of the cooling rolls 1 as the molten metal in the molten bath is cooled by the cooling rolls 1. Abnormal growth of the solidified shells is observed at the so-called triple points (i.e., the points of contact between the cooling roll 1, the side seal plate 2 and the molten metal since the molten metal tends to tarry and thus tends to be sooner cooled at the triple points. The abnormally grown solidified shells are pulled by the solidified shells developed on the cooling rolls 1 and drops (separated) into the gap between the cooling rolls 1. As a result, not only the surfaces of the cast piece may be degraded, but also the thickness of the cast piece may be increased locally, causing breakdown of the same. In addition, drop of the abnormally grown solidified shells may cause damages on the side seal plates 2.

To overcome such triple problem, it has been devised and demonstrated to pour the molten metal 5 into a core 4 disposed in the molten bath and is caused to flow through holes 6 on the core 4 into the gap between the cooling rolls 1 in a fluidized state for prevention of the abnormal growth of the solidified shells at the triple points.

However, even the above-described system cannot satisfactorily overcome in practice the triple-point problem because it is impossible to effectively melt only the harmful solidified shells grown at the triple points. More specifically, when the molten metal is directed to flow directly toward the triple points, not only the solidified shells at the triple points but also the solidified shells on the cooling rolls are melted.

In view of the above, according to the present invention, of the solidified shells grown at the triple points, only the solidified shell which are harmful and are grown at the side seal plate is effectively melted away.

The above and other objects, effects, features and advantages of the present invention will become more apparent from the following description of preferred embodiments thereof taken in conjunction with the accompanying drawings.

DETAILED DESCRIPTION OF THE PREFERRED EMBODIMENTS

Figure 1:
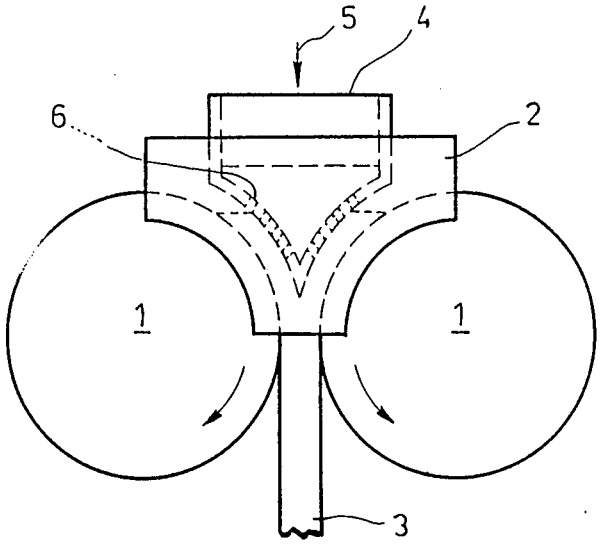
Fig.1 PRIOR ART
FIG. 1 is a schematic side view of a conventional dual roll type continuous casting machine.
Figure 2:
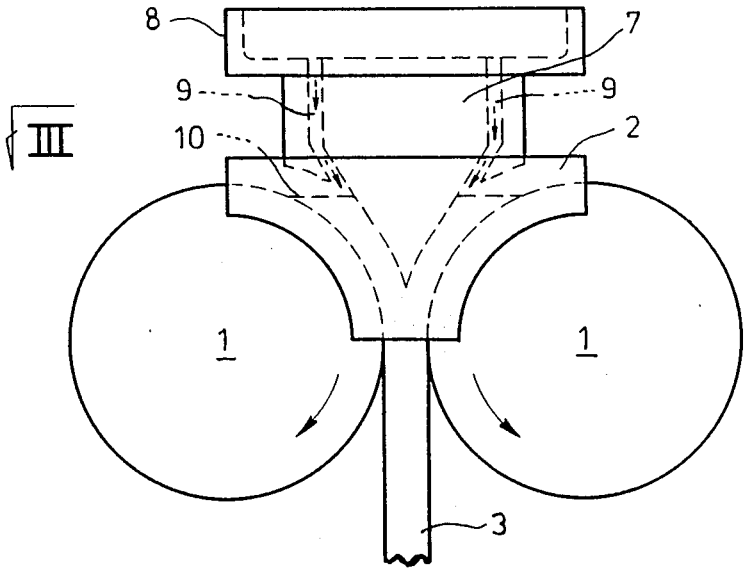
FIG. 2 is a schematic side view of a first embodiment of the present invention.
Figure 3:
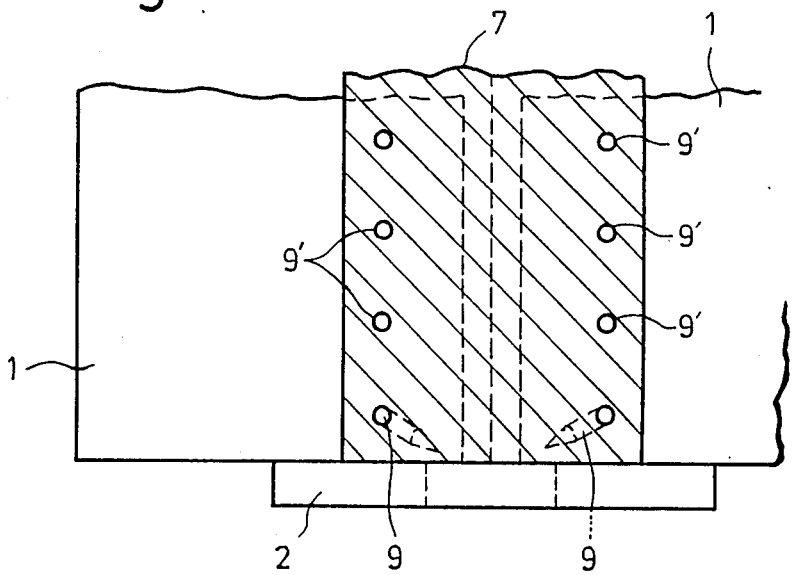
FIG. 3 is a sectional view looking in the direction indicated by the arrow III in FIG. 2.

Referring first to FIGS. 2 and 3, side seal plates 2 are disposed at the ends of a pair of cooling rolls 1 to define a molten bath or pool. A core 7 is accomodated in the molten bath between the side seal plates 2. Inclined molten-metal-pouring passages 9 are formed on the core 7 adjacent to the side edges thereof so that the molten metal in a tundish 8 which is disposed integrally on the core 7 is caused to flow toward the side seal plates 2 in the directions tangential to the cooling rolls 1. Vertical pouring passages 9' are disposed along the width of the core 7 and intermediately of the side edges thereof. The pouring passages 9 and 9' are located slightly above a surface level 10 of the molten metal in the molten bath so that the solidification at the surface level 10 and the clogging of the pouring passages 9 and 9' can be avoided.

As described above, according to the present invention, the molten metal is caused to flow through the inclined pouring passage 9 of the core 7 toward the side seal plate 2 in the tangential direction relative to the cooling roll 1 so that the molten metal can flow along the surface of contact between the side seal plates 2 and the peripheral edges of the cooling rolls 1. As a consequence, only the solidified shells on the side seal plate at the triple points can be effectively melted.

In the case of large-diameter cooling rolls 1, a plurality of pouring passages 9 are formed along the periphery of each cooling roll 1 and are opened in the molten bath. This arrangement is advantageous when, because of the cooling rolls being large in diameter, the solidified shells on the side seal plates at the outlet of the molten bath cannot be melted by pouring the molten metal only from above the molten bath.

Figure 4:
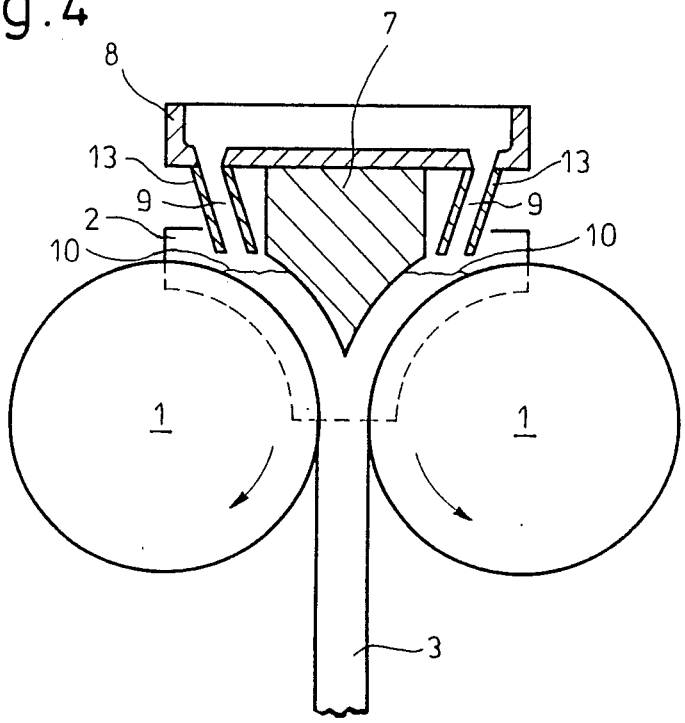
FIG. 4 is a schematic side view of a second embodiment of the present invention.

In a second embodiment of the present invention as shown in FIG. 4, instead of forming the pouring passages 9 through the core 7, molten-metal-pouring nozzles 13 each having a pouring passage 9 adapted to charge the molten metal toward the side seal plate 2 in the direction tangential to the cooling roll 1 extend from the tundish 8 independently of the core 7.

Figure 5:
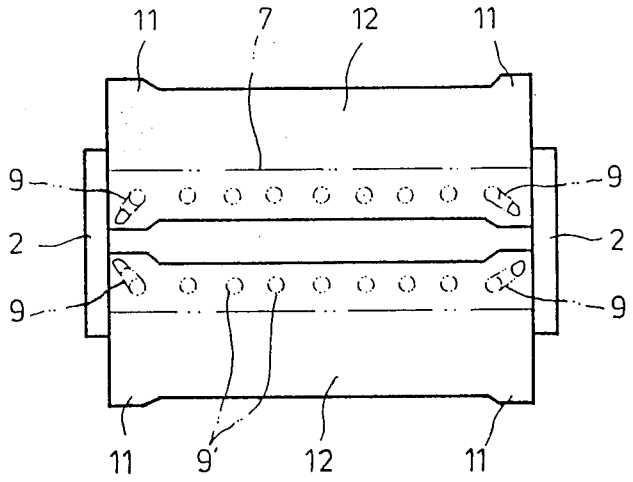
FIG. 5 is a schematic side view of a third embodiment of the present invention.

A third embodiment of the present invention as shown in FIG. 5 is directed to solving the problem that the solidified shell grown on the surface of the cooling roll may be slightly melted by the molten metal fed to the triple points through the inclined pouring passages 9 so that the solidification at the ends of the cast piece 3 is retarded, resulting in the leakage of the molten metal after the cast piece 3 has left the cooling rolls 1. To this end, used are stepped rolls 12 each having steps 11 at both ends which are slightly greater in diameter.

The stepped rolls 12 have their steps 11 pressed against the solidified shells at both ends of the cast piece. As a result, the so-called triple point problem as well as the leakage problem can be overcome simultaneously. Instead of forming the steps 11, the rolls 12 may be tapered at their axial ends.

It is to be understood that the present invention is not limited to the above-described embodiments and that various modifications may be effected without leaving the true spirit of the present invention.

As described above, according to the present invention, the molten metal can be directed through the pouring passages toward the side seal plates in the directions tangential to the cooling rolls so that only the solidified shells on the side seal plates at the so-called triple points can be effectively melted, whereby the so-called triple point problem can be ovecome.

What is claimed is:

1. A dual roll type continuous casting machine in which a molten bath is defined at least by a pair of parallel cooling rolls and side seal plates disposed at both axial ends of said pair of cooling rolls, a core being inserted into and disposed in said molten bath, comprising nozzles located on opposite sides of the core, each nozzle including at least one molten-metal-pouring passage formed through said core, said nozzles opening between a respective side of the core and a corresponding cooling roll, and said molten-metal-pouring passages are disposed so that molten metal is fed toward said side seal plates in directions tangential to said corresponding cooling rolls.

2. A machine according to claim 1 wherein the axial ends of said pair of cooling rolls are stepped such that a roll gap between said pair of cooling rolls is made narrower at their axial ends.

3. A machine according to claim 1 wherein the axial ends of said pair of cooling rolls are tapered such that a roll gap between said pair of cooling rolls is made narrower at their axial ends.

4. A dual roll type continuous casting machine in which a molten bath is defined at least by a pair of parallel cooling rolls and side seal plates disposed at both axial ends of said pair of cooling rolls, a core being inserted into and disposed in said molten bath, comprising molten-metal-pouring nozzles, each of said nozzles being disposed between a corresponding cooling roll and the core independently of said core, each of said nozzles having molten-metal-pouring passages disposed for feeding molten metal toward each of said side seal plates in a direction tangential to the corresponding cooling roll.

5. A machine according to claim 4 wherein the axial ends of said pair of cooling rolls are stepped such that a roll gap between said pair of cooling rolls is made narrower at their axial ends.

6. A machine according to claim 4 wherein the axial ends of said pair of cooling rolls are tapered such that a roll gap between said pair of cooling rolls are made narrower at their axial ends.

* * * * *